US007114480B2

(12) United States Patent
Murata et al.

(10) Patent No.: US 7,114,480 B2
(45) **Date of Patent: *Oct. 3, 2006**

(54) V-TYPE ENGINE

(75) Inventors: Shinichi Murata, Okazaki (JP); Masayuki Kamo, Okazaki (JP); Kunitoshi Kajiwara, Chiryu (JP); Daisuke Kitada, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 26 days.

This patent is subject to a terminal disclaimer.

(21) Appl. No.: 10/859,123

(22) Filed: Jun. 3, 2004

(65) Prior Publication Data

US 2005/0011695 A1 Jan. 20, 2005

(30) Foreign Application Priority Data

Jun. 5, 2003 (JP) ..... 2003-160975

(51) Int. Cl.
*F02F 7/00* (2006.01)

(52) U.S. Cl. ..... 123/195 R; 123/54.4; 180/297

(58) Field of Classification Search ..... 123/196 R, 123/54.4, 195 A; 180/297
See application file for complete search history.

(56) References Cited

U.S. PATENT DOCUMENTS 4,637,354 A * 1/1987 Tominaga et al. ..... 123/54.4
5,653,201 A * 8/1997 Hosoya ..... 123/184.34
6,647,944 B1 * 11/2003 Kamiya ..... 123/195 R
6,920,869 B1 * 7/2005 Murata et al. ..... 123/572

FOREIGN PATENT DOCUMENTS

JP 3-281901 A 12/1991

* cited by examiner

*Primary Examiner*—Tony M. Argenbright
*Assistant Examiner*—Katrina Harris
(74) *Attorney, Agent, or Firm*—Birch, Stewart, Kolasch & Birch, LLP

(57) ABSTRACT

There is provided a V-type engine in which banks of an engine block are offset in the same direction as the rotational direction of a crankshaft so that the banks may be displaced toward an end of a vehicle body. On the offset side, engine accessory is mounted on a side of the engine block and below the banks. The width between the end of the engine accessory to which an impact is input first among component parts of the engine block and the end of the rear bank where the engine block moved due to the impact is abutted first on a vehicle body member is set to be shorter than in a conventional engine. Therefore, the crushable zone may be increased even in a limited engine compartment.

7 Claims, 2 Drawing Sheets

V-TYPE ENGINE

CROSS-REFERENCE TO RELATED APPLICATION

This application incorporates by reference the subject matter of Application No. 2003-160975 filed in Japan on Jun. 5, 2003, on which a priority claim is based under 35 U.S.C. § 119(a).

BACKGROUND OF THE INVENTION

1. Field of the Invention

The present invention relates to a V-type engine which is transversely mounted in an engine compartment formed at an end of a vehicle body.

2. Description of the Related Art

In many passenger vehicles (or vehicles), an engine is mounted in an engine compartment provided at the front end of a vehicle body adjacent to a cabin.

A multiple cylinder engine is long if it is a straight in-line cylinder engine, and hence in recent years, an increasing number of multiple cylinder engines have been constructed such that a V-type engine in which cylinders are divided into right and left banks is transversely mounted in an engine compartment.

To protect occupants from an impact in the event of a collision, passenger vehicles are required to ensure safety against the collision. Accordingly, an engine compartment is usually set as a crushable zone, and when an impact equal to or greater than a predetermined value is applied via the front end of a vehicle body, a frame of the vehicle body, which forms the engine compartment, is crushed to absorb an impact energy and protect a cabin where occupants are seated.

However, the engine is not crushed in the event of a vehicle collision since it is rigid. Thus, in the event of a vehicle collision, the engine compartment is crushed from the front end thereof, and the crushed part of the engine compartment abuts an engine block, and when an impact is input to the engine block, the engine block is displaced rearward while crushing the frame of the engine compartment, and abuts a toe board which partitions the vehicle body into the cabin and the engine compartment, and then causes e.g., deformation of the toe board, so that the impact can be absorbed.

Particularly in the case of the V-type engine, since it is transversely mounted in the engine compartment, large-sized engine accessory (such as a compressor for an air conditioner, an oil pump for power steering, and an alternator) is disposed at a location which is substantially level with a bumper to which impact is input, and the bank in the rear is likely to abut the toe board first.

The safety of vehicles against collision has been climbing to a higher level year by year.

The engine compartment, however, is restricted by the design of a vehicle, a car model, and so forth, and hence it is difficult to secure a large space required for a high collision safety. Particularly in the transverse-mounted V-type engine, both banks are protruded in the direction of the length of a vehicle, and hence it is difficult to secure a sufficient crushable zone.

Therefore, regarding the V-type engine, the technology in which the axes of cylinders are offset from the center of a crankshaft has been proposed. According to this technology, the axes of cylinders in respective banks are offset from the center of the crankshaft in the rotational direction of the crankshaft, and the banks are drawn along the axes of the cylinders to the center of the crankshaft, so that the distance between the center of the crankshaft and the lower surfaces of the cylinders in the banks (i.e., the level of the cylinder surface) can be reduced to make the V-type engine compact (refer to Japanese Laid-Open Patent Publication No. 3-281901, for example)

However, if the banks are drawn along the axes of the cylinders to the center of the crankshaft, it is necessary to modify many parts of an engine. Moreover, if the banks are drawn to the center of the crankshaft, the lower surfaces of the cylinders in one bank may enter into the cylinders in the other bank and interfere with connecting rods of the bank, and some measures must be taken to address this problem.

For this reason, the above technology has the problem that the V-type engine is considerably complicated in structure and requires high cost.

SUMMARY OF THE INVENTION

The present invention provides a V-type engine which may increase the crushable zone with a simple construction and at low cost.

In a first aspect of the present invention, there is provided a V-type engine which includes an engine block mounted in an engine compartment formed at an end of a vehicle body such that banks are arranged in the direction of length of the vehicle body, wherein the engine block is constructed such that the banks are offset in a direction identical with the rotational direction of a crankshaft so that the banks are displaced toward the end of the vehicle body, and on the offset side, engine accessory is mounted on a side of the engine block and below the banks.

According to the first aspect of the present invention, with the engine which has a simple construction and requires low cost, the width of the engine between the engine accessory to which impact is input first and the bank on the opposite side where the engine block moved due to the impact is abutted first on a vehicle body member can be reduced as compared with a conventional engine (with zero offset).

Due to the reduction in width, it is possible to increase the crushable zone in the engine compartment, and even if the engine compartment is limited in space, the safety against collision can be improved. Moreover, a high versatility can be realized since the above effect can be obtained in most of vehicles which are constructed such that a V-type engine is transversely mounted in an engine compartment.

In a preferred form, the banks of the V-type engine are identical in deck height with banks of a zero-offset engine.

Therefore, it is possible to prevent the lower surfaces of cylinders in the banks from interfering with e.g., connecting rods, and to make the construction of the V-type engine less complicated and at a reduced cost.

In a second aspect of the present invention, there is provided a V-type engine mounted in an engine compartment formed at front or rear of a vehicle body, including: a crankshaft disposed in the direction of width of the vehicle body; two banks arranged in the direction of length of the vehicle body, and being identical in deck height with each other; cylinders provided in respective ones of the banks, axes of the cylinders being offset with respect to the crankshaft in a direction identical with the rotational direction of the crankshaft; and engine accessory mounted on a side of the V-type engine and below the banks at an end in the direction of the length of the vehicle body, wherein the V-type engine is mounted in the engine compartment such that the axes of the cylinders are offset in a direction toward the end.

According to the second aspect of the present invention, with the engine which has a simple construction and requires low cost, the width of the engine between the engine accessory to which impact is input first and the bank on the opposite side where the engine block moved due to the impact is abutted first on a vehicle body member can be reduced as compared with a conventional engine, and the crushable zone can be increased even in the engine compartment limited in space.

As a result, due to the reduction in the width, it is possible to increase the crushable zone in the engine compartment, and even if the engine compartment is limited in space, the safety against collision can be improved. Moreover, a high versatility can be realized since the above effect may be obtained in most of vehicles which are constructed such that a V-type engine is transversely mounted in an engine compartment.

Preferably, the engine accessory is shaped such that part thereof overhangs outward from an end of the bank located just above the engine accessory.

Therefore, it is possible to increase the probability that when an impact is applied to the front of the vehicle, the impact is input first to the engine accessory, and to reduce the width of the engine, so that the crushable zone can be further increased.

BRIEF DESCRIPTION OF THE DRAWINGS

The present invention will become more fully understood from the detailed description given herein below and the accompanying drawings which are given by way of illustration only, and thus are not limitative of the present invention, and wherein:

In FIG. 1, reference numeral 1 denotes a vehicle body; 2, a cabin constituting the vehicle body 1; and 3, an engine compartment provided, e.g., provided in front of the cabin 2. The cabin 2 and the engine compartment 3 are partitioned by a toe board 4. Reference numeral 5 denotes an instrument panel mounted in the cabin 2; 6, a steering wheel protruding from the instrument panel 5; and 7, a front seat.

Figure 1:
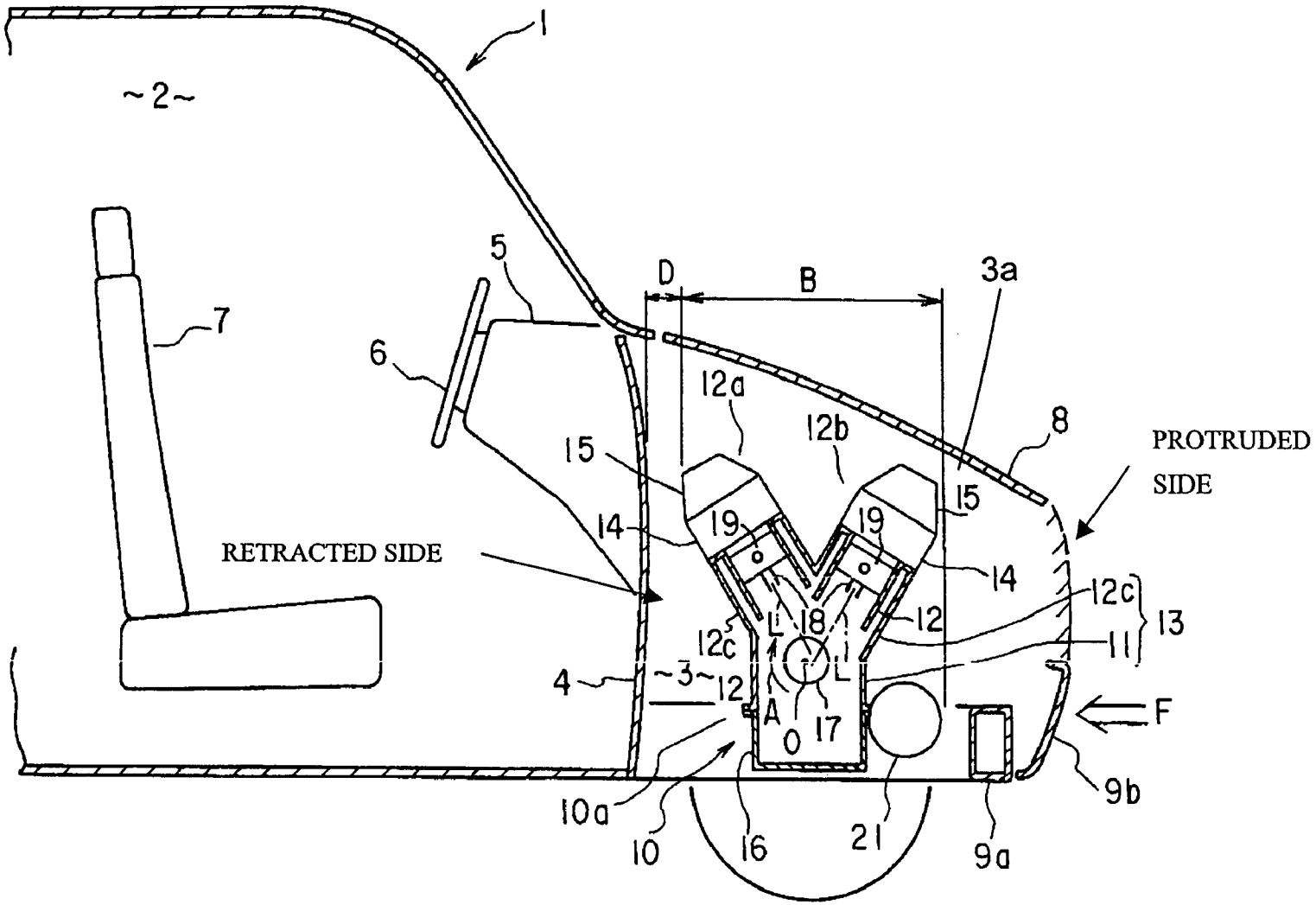
FIG. 1 illustrates a passenger vehicle (or a vehicle) to which the present invention is applied.

The engine compartment 3 is formed with an opening 3*a* at the top thereof for maintenance, and the opening 3*a* is closed by an engine hood 8 which can be tilted forward. The engine compartment 3 is set as a crushable zone through its overall length, so that when impact energy equal to or greater than a predetermined value is applied via the front of the vehicle body 1, the engine compartment 3 is crushed from the front thereof. It should be noted that reference numeral 9*a* denotes a front cross member (a cross member at the foremost part of a chassis frame) disposed in a lower part of the front of the engine compartment 3, and reference numeral 9*b* denotes a bumper mounted in front of the front cross member 9*a*.

DETAILED DESCRIPTION OF THE INVENTION

A description will now be given of a V-type engine according to an embodiment of the present invention with reference to FIGS. 1 and 2.

Figure 2:
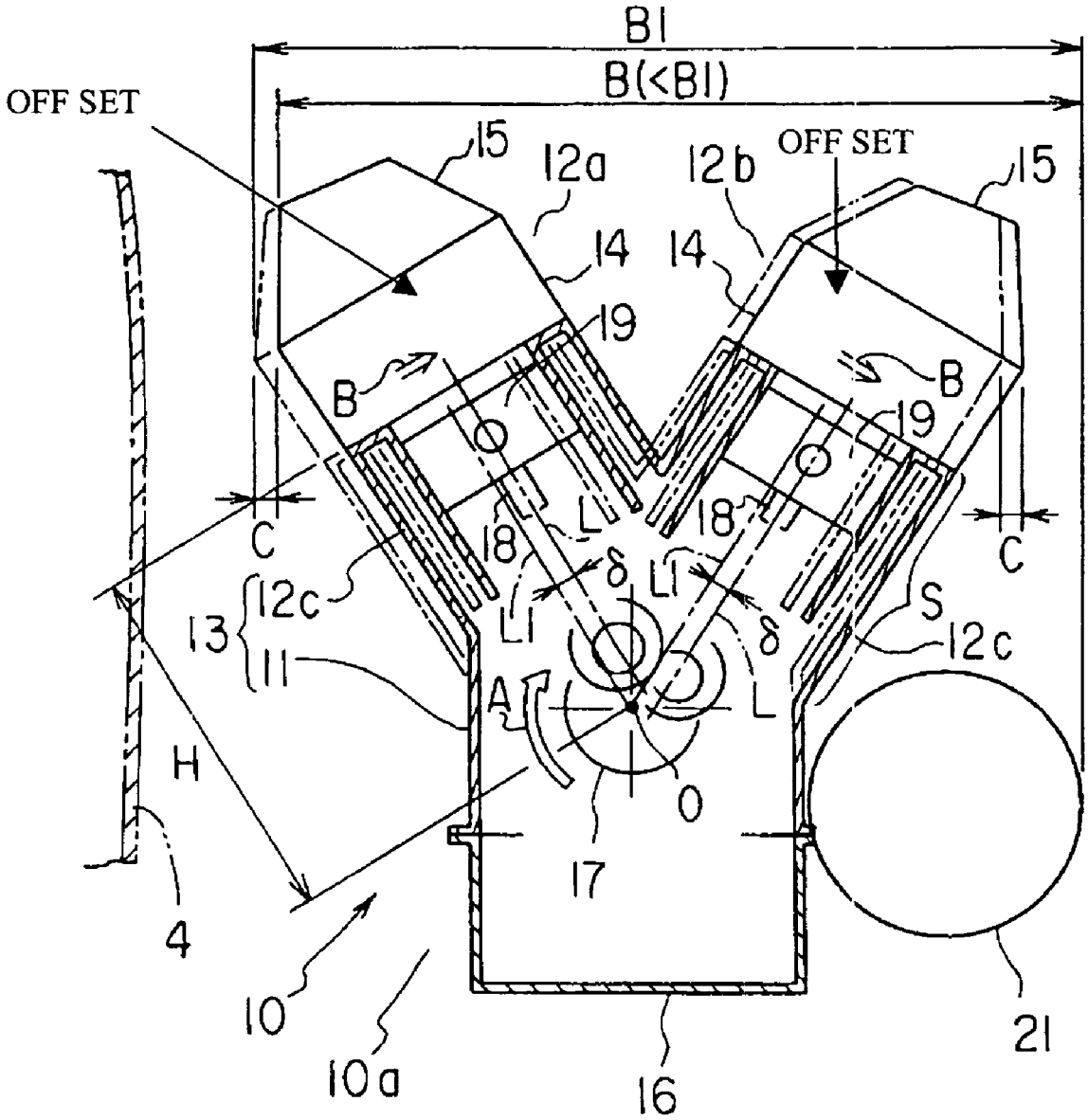

FIG. 1 illustrates a passenger vehicle (or a vehicle) to which the present invention is applied. In FIG. 1, reference numeral 1 denotes a vehicle body; 2, a cabin constituting the vehicle body 1; and 3, an engine compartment provided e.g. in front of the cabin 2. The cabin 2 and the engine compartment 3 are partitioned by a toe board 4. Reference numeral 5 denotes an instrument panel mounted in the cabin 2; 6, a steering wheel protruding from the instrument panel 5; and 7, a front seat.

The engine compartment 3 is formed with an opening 3*a* at the top thereof for maintenance, and the opening 3*a* is closed by an engine hood 8 which can be tilted forward. The engine compartment 3 is set as a crushable zone through its overall length, so that when impact energy equal to or greater than a predetermined value is applied via the front of the vehicle body 1, the engine compartment 3 is crushed from the front thereof. It should be noted that reference numeral 9*a* denotes a front cross member (a cross member at the foremost part of a chassis frame) disposed in a lower part of the front of the engine compartment 3, and reference numeral 9*b* denotes a bumper mounted in front of the front cross member 9*a*.

An engine, e.g., a V-type engine 10 for driving the vehicle is mounted in the engine compartment 3.

A description will now be given of the construction of the V-type engine 10. As shown in FIGS. 1 and 2, an engine block 10*a* of the engine 10 is comprised mainly of a V-shaped cylinder block, i.e., a cylinder block 13 in which V-shaped deck cylinder parts 12*c* with cylinders 12 divided into predetermined cylinder banks are formed on the upper side of a common crankcase 11, cylinder heads 14 mounted on the respective deck cylinder parts 12*c*, cam covers 15 mounted on the respective cylinder heads 14, and an oil pan 16 which covers the bottom of the crankcase 11.

The deck cylinder parts 12*c*, cylinder block 13, and cam covers 15 constitute banks 12*a* and 12*b* which protrude in V-shape. A crankshaft 17 extending in the direction of the overall length of the engine 10, which is perpendicular to the axes of the cylinders 12, is rotatably supported in the crankcase 11. Pistons 19 housed in the respective cylinders 12 are rotatably connected to the crankshaft 17 via connecting rods 18.

The cylinder head 14 of each cylinder 12 has intake and exhaust valves, a valve system for the intake and exhaust valves, an ignition plug, and an injector, none of which is illustrated, incorporated therein. The operation of these component parts, i.e., the operation of the piston 19, intake and exhaust valves, and ignition plug in predetermined timing realizes a combustion cycle comprised of an intake stroke, a compression stroke, an explosion stroke, and an exhaust stroke. An arrow A indicates a direction in which the crankshaft 17 is rotated during such an operation.

The V-type engine 10 is transversely mounted in the engine compartment 3, i.e., the banks 12*a* and 12*b* in the upper part of the engine 10 are disposed in the direction of the length of the vehicle, and the crankshaft 17 in the lower part of the V-type engine 10 is disposed in the direction of the width of the vehicle.

The banks 12*a* and 12*b* of the V-type engine 10 are offset in the same direction as the rotational direction of the crankshaft 17 (the direction indicated by the arrow A) so that they can be displaced toward an end of the vehicle body 1, i.e., forward in the direction of the length of the vehicle.

This will now be described in further detail. A conventional engine (a V-type engine in which banks are not offset ($\delta=0$)) is constructed such that the axes L1 of the cylinders 12 in the banks 12*a* and 12*b* are provided at such locations as to pass through the center O of the crankshaft 17 as shown in FIG. 2. In FIG. 2, chain double-dashed lines indicate the outlines of the banks 12*a* and 12*b* on this occasion. In the offset V-type engine 10, while the deck height H represented by the length between the center O of the crankshaft 17 and the deck surface of the cylinder block 13 remains unchanged, the axes L1 of the deck cylinder parts 12*c* (the banks 12*a* and 12*b*) are moved parallel to the positions of axes L as offset points and in the same direction as the rotational direction (indicated by the arrow A) of the crankshaft 17 with respect to the center O of the crankshaft 17, so that the banks 12*a* and 12*b* are displaced in the same direction as the rotational direction of the crankshaft 17. δ indicates the offset distance on this occasion. It should be noted that in the present embodiment, the axes L of the cylinders 12 constituting the bank 12*a* are present within a flat surface parallel with the crankshaft 17. This is also the case with the bank 12*b*. The deck heights H of the respective banks 12*a* and 12*b* are set to be equal.

Further, as mentioned above, the deck height H is equal to that of an engine with zero offset (δ=0). Therefore, the interference of the deck cylinder parts 12*c* of the banks 12*a* and 12*b* and the cylinders 12 and the lower end of sliding surfaces of the pistons 19 and the connecting rods 18 can be prevented, and furthermore, the structure of the engine can be simplified, and the cost can be reduced.

The above offset causes the bank 12*b* in the rear as viewed from the cabin 2 to be protruded forward in the length of the vehicle body by C as compared with the conventional engine, and causes the bank 12*a* in the front as viewed from the cabin 2 to move away by C from the toe board 4 as compared with the conventional engine. It should be noted that C is represented by the following expression: COS (θ/2)×δ where θ indicates the bank angle of the banks 12*a* and 12*b*.

Further, engine accessory 21 such as a compressor for an air conditioner, an oil pump for a power steering, and an alternator, driven by brake power from the crankshaft 17, is mounted on a side of the engine block 10*a* which is opposed to the front of the vehicle and at a location below the bank 12*b*,i.e., a location which is not offset below the height S of the deck cylinder parts 12*c*, and for example, on a side of the crankcase 11 of the cylinder block 13. The engine accessory 21 is large in size and is shaped such that part thereof overhangs outward from the bank 12*b* (on the front of the vehicle body).

Here, since the V-type engine 10 is transversely mounted in the engine compartment 3 as shown in FIG. 1, the large-sized engine accessory 21 is disposed, such that it is substantially level with the bumper 9*b* and the front cross member 9*a* to which impact is input first, and the rear bank 12*a* is abutted first on the toe board 4 as a vehicle body member.

Specifically, e.g., in the event of a vehicle collision, an impact F equal to or greater than a predetermined value is applied via the bumper 9*b* located in the foremost part of the vehicle body 1 as shown in FIG. 1, the bumper 9*b* and the front cross member 9*a* in front of the engine 10 are crushed first, and then the crushed part of the front cross member 9*a* abuts the body of the engine accessory 21, so that the impact is input to the engine block 10*a*. Here, the engine block 10*a* is not crushed since it is rigid; the engine block 10*a* is displaced rearward while crushing a frame which forms the engine compartment 3, and the rear bank 12*a* abuts the toe board 4 to cause, e.g., deformation of the toe board 4 so that the applied impact may be absorbed.

On this occasion, the width B of the V-type engine 10 between the end of the engine accessory 21 to which impact is input first and the end of the 12*a* on the opposite side where the engine block 10*a* moved due to the impact abuts the toe board 4 first is shorter than the width B1 of the conventional engine (with zero offset) indicated by the chain double-dashed lines (B<B1).

This means that within the range of the overall length of the engine compartment 3 limited in space, the crushable zone can be increased by C which corresponds to the decrease in the width of the engine block 10*a*.

Therefore, the crushable zone may be increased with such a simple and inexpensive structure of the engine that the banks 12*a* and 12*b* are offset in the rotational direction of the crankshaft 17.

Further, in most of vehicles constructed such that the V-type engine 10 is transversely mounted in the engine compartment 3, it is arranged such that impact is input to the engine accessory 21 first, and the rear bank 12*a* abuts the toe board 4 first. Therefore, a high versatility can be realized.

Further, such a known effect that thrust applied to the pistons 19 during an explosion stroke is reduced can be obtained since the cylinders 12 are offset in the same direction as the rotational direction (indicated by the arrow A) of the crankshaft 17.

It should be understood that the present invention is not limited to the embodiment described above, but various changes in or to the above-described embodiment may be possible without departing from the spirits of the present invention.

For example, although in the above-described embodiment, the right and left banks are offset by the same offset distance, they may be offset by different offset distances insofar as engine performance is not affected. Further, although in the above-described embodiment, each bank of the V-type engine is comprised of the deck cylinder parts of the cylinder block, cylinder heads, and the cam covers, the present invention is not limited to this, but each bank of the V-type engine may be comprised of the deck cylinder parts of the cylinder block and the cylinder heads, or may be comprised of deck cylinder parts separated from the cylinder block, not the deck cylinder parts integrated with the cylinder block.

Further, although in the above described embodiment, the V-type engine is mounted in front of the cabin, the present invention is not limited to this, but the V-type engine may be transversely mounted in rear of the cabin, i.e., in an engine compartment formed in rear of the cabin. It suffices that the V-type engine is transversely mounted in an engine compartment formed at an end of a vehicle.

We claim:

1. A V-type engine, comprising:

an engine block mounted in an engine compartment formed at an end of a vehicle body such that banks are arranged in a direction of a length of the vehicle body, said engine block being constructed such that the banks are offset in a direction identical with a rotational direction of a crankshaft such that the banks are displaced toward the end of the vehicle body, and on the offset side; and an engine accessory mounted on a side of the engine block and below the banks.

2. A V-type engine according to claim 1, wherein the banks of the V-type engine are identical in deck height with banks of a zero-offset engine.

3. A V-type engine according to claim 1, wherein the engine accessory is shaped such that part thereof overhangs outward from an end of the bank located just above the engine accessory.

4. A V-type engine mounted in an engine compartment formed on front or rear of a vehicle body, comprising:

a crankshaft disposed in a direction of width of the vehicle body;

two banks arranged in a direction of a length of the vehicle body, and being identical in deck height with each other;

cylinders provided in each of the banks, axes of said cylinders being offset with respect to said crankshaft in a direction identical with a rotational direction of said crankshaft; and an engine accessory mounted on a side of an engine block of the V-type engine and below said banks at an end in the direction of the length of the vehicle body, wherein the V-type engine is mounted in the engine compartment such that the axes of said cylinders are offset in a direction toward the end.

5. A V-type engine according to claim 4, wherein said engine accessory is shaped such that part thereof overhangs outward from an end of one of said bank located just above said engine accessory.

6. A structure for mounting a V-type engine on a vehicle, comprising:

an engine compartment defined by a cross member provided at an end of the vehicle and a panel provided at an end of a passenger compartment; and a V-type engine including, an engine block, having first and second banks, mounted in the engine compartment, such that the first bank and the second bank are arranged in a direction along a length of the vehicle and the first bank faces the end of the vehicle and the second bank faces the panel, the first bank and the second bank being offset toward the end of the vehicle with respect to a rotational axis of a crankshaft, and an engine accessory mounted on a side of the engine block and below the first bank, such that at least a part of the engine accessory extends outward from an end of the first bank and opposes the cross member.

7. A V-type engine, comprising:

an engine block mounted in an engine compartment formed at an end of a vehicle body such that banks are arranged in a direction of a length of the vehicle body, said engine block being constructed such that the banks are offset in a direction identical with a rotational direction of a crankshaft such that the banks are displaced toward the end of the vehicle body, and on the offset side; and an engine accessory mounted on a side of the engine block and below the banks and facing a front end of the vehicle body, such that a bank closer to a vehicle compartment makes contact with a wall that separates a passenger compartment and an engine compartment before other component of the engine makes contact with the wall.

* * * * *